United States Patent [19]

Lardellier

[11] Patent Number: 4,648,795

[45] Date of Patent: Mar. 10, 1987

[54] CONTAINMENT STRUCTURE FOR A TURBOJET ENGINE

[75] Inventor: Alain M. J. Lardellier, Melun, France

[73] Assignee: Societe Nationale d'Etude et de Construction de Meteur d'Aviation "S.N.E.C.M.A.", France

[21] Appl. No.: 805,799

[22] Filed: Dec. 6, 1985

[30] Foreign Application Priority Data

Dec. 6, 1984 [FR] France ..... 84 18593

[51] Int. Cl.[4] ..... F04D 29/54

[52] U.S. Cl. ..... 415/196; 415/9; 415/174; 415/197

[58] Field of Search ..... 415/196, 197, 174, 9, 415/119, 200, 170, 219

[56] References Cited

U.S. PATENT DOCUMENTS 4,063,847 12/1977 Simmons ..... 415/219 R
4,295,787 10/1981 Lardellier ..... 415/197
4,452,563 6/1984 Belanger et al. ..... 415/197
4,475,865 10/1984 Patacca et al. ..... 415/219 R

*Primary Examiner*—Robert E. Garrett
*Assistant Examiner*—John Kwon
*Attorney, Agent, or Firm*—Bacon & Thomas

[57] ABSTRACT

The invention discloses a confinement structure for a turbojet engine to retain and confine fragments of a rotor blade. The structure has three zones of varying vulnerability to the blade fragments so as to maximize the confinement of such fragments, while minimizing the weight of the structure. A first zone, located in the plane of rotation of the rotor blade wheel confines the small fragments which may impact in this zone. A second zone, adjacent to the first, but located downstream, contains a retention belt structure to absorb the energy generated by contact with the larger blade fragments. Finally, a third zone, downstream of the second zone, defines a containment chamber to retain the larger blade fragments.

5 Claims, 1 Drawing Figure

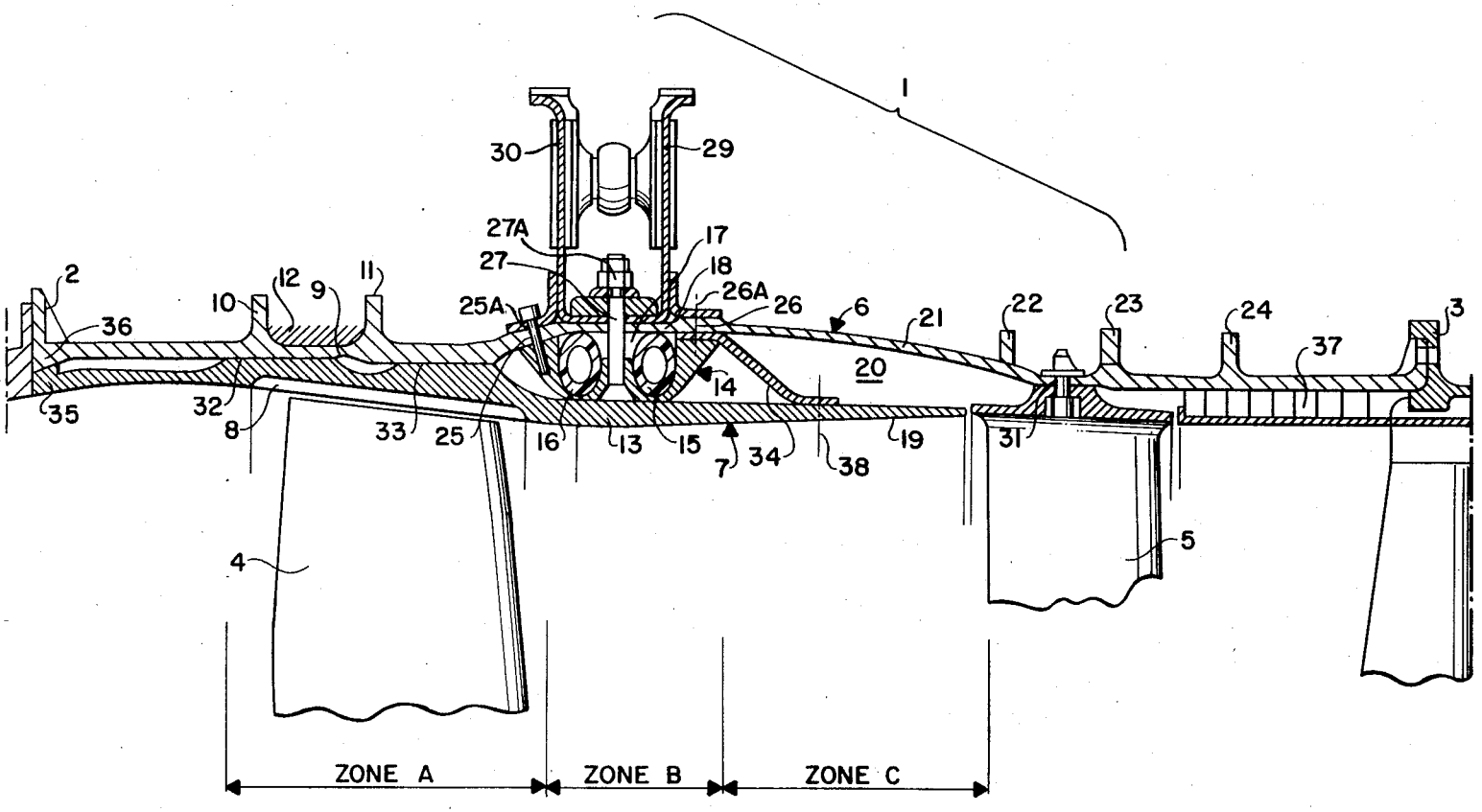
ZONE C
ZONE B
ZONE A

CONTAINMENT STRUCTURE FOR A TURBOJET ENGINE

FIELD OF THE INVENTION

The instant invention relates to a containment structure for a turbojet engine, specifically such a structure having three separate zones for containing fragments of a broken turbine rotor blade.

BRIEF DESCRIPTION OF THE PRIOR ART

Containment structures for turbine rotor blade wheels are well known in the art and have been utilized for many years to contain fragments of broken rotor blades. Typically, these containment structures comprise a relatively thin steel casing having plastic tapes or fibers (such as aromatic polyamide fibers known as KEVLAR) attached thereto, such as by winding either on the interior or the exterior of the steel casing. In relatively large turbine structures, the use of these plastic tapes or fibers provides a significant savings in weight over an all metal containment structure. However, in relatively small turbojet engines, it does not provide a substantial savings in weight over the all steel casing.

Blade rupture tests have shown three different zones of vulnerability in the surrounding casing:

(a) A first zone (zone A) located in the plane of rotation of the rotor blade wheel is impacted only by small fragments and, generally, no perforation of the casing takes place at this location;

(b) A second zone (zone B) immediately downstream of the first zone (in the direction of air flow) is subject to larger impacts, in particular from the blade roots following separation of the blade fragments. This zone typically suffers substantial deformation or perforations;

(c) A third zone (zone C) downstream of the second zone has a vulnerability comparable to that of the first zone, i.e., limited deformation or perforation takes place.

Since, in many cases, the casing itself cannot effectively carry out the retention and containment functions, it has been proposed in U.S. Pat. No. 4,411,589 to Joubert et al to incorporate a retaining structure consisting of one or more hollow toroids arranged concentrically with the rotor between the casing and a sealing shroud ring. Since the retaining structure carries out most of the containment and retaining functions, the casing only need resist the dynamic stresses and damp the vibrations encountered during the engine operation.

SUMMARY OF THE INVENTION

The present invention defines a containment structure having zones of varying vulnerability to effectively confine the rotor blade fragments so as to minimize damage to the remainder of the engine structure, and at the same time one which permits a substantial weight savings by the use of a light-alloy casing. The light-alloy casing, which may be AU2GN, has a thickness equivalent to that of a conventional steel casing which permits weight savings on the order of 30–40 kg. Although the strength with respect to dynamic stresses and vibration damping for such a light-alloy casing is approximately the same as that for a steel casing, quite obviously the light-alloys are more susceptible to being perforated or otherwise deformed by the blade fragments. Accordingly, an inner liner and a retention belt structure are attached to the interior of the casing between it and the rotor blade wheel.

It is an object of this invention to provide a containment and retention casing wherein the structure provides a plurality of zones of varying vulnerability to provide adequate containment, while at the same time minimizing the weight of the structure.

This objective is achieved by providing the light-alloy, metallic external casing with an inner liner formed of a composite material which is removably attached to the inner surface of the outer casing. This assembly defines at least three zones having different containing and retaining characteristics.

BRIEF DESCRIPTION OF THE FIGURE

The single FIGURE is a partial, sectional view showing the containment structure according to the invention.

DETAILED DESCRIPTION OF THE PREFERRED EMBODIMENT

The retention casing according to the invention is generally designated at 1 and has end brackets 2 and 3 by which it is attached to the intake and outlet casings (both omitted) of the turbine structure. The containment structure surrounds rotor blade wheel 4 and has air-stream straightening vanes 5 attached thereto.

The containment structure comprises an outer metallic casing 6 having an inner lining 7 which defines the wall of the flow channel of the air-stream passing through the rotor blade wheel. The lining 7 may be formed, at least in part, of a composite material and is located concentrically within the casing 6.

The assembly defines at least three adjacent zones, each having a different retaining and containment capability, depending on their positions with respect to the rotor blade wheel. The first zone, denoted zone A in the FIGURE, lies about the periphery of the rotor wheel 4 in the plane of its rotation. The containment structure in this zone includes an abradable sealing ring 8 which is mounted in a recess formed within the lining 7, and the annular portion 9 of the outer casing 6. Radially extending flanges 10 and 11 extend from the portion 9 of casing 6. A retaining ring 12, which may be formed of a winding of aromatic-polyamide fibers embedded in a synthetic resin, is placed around the exterior of the portion 9 between the radial flanges 10 and 11. The portion 9 between the radial flanges 10 and 11 is provided approximately in the upstream half of the first zone (zone A) and is capable of slowing down and retaining the blade fragments that may detach from the rotor blade wheel 4.

The second zone (zone B) is located immediately downstream of zone A and includes the lining 7, a retention belt structure 14 and annular portion 18 of outer casing 6. The retention belt structure 14 may comprise a pair of toroidal retention members 15 and 16 attached to the inside surface of outer casing 6 by a plurality of supports 17.

The third zone (zone C) extends downstream of the second zone and is typically equal in length to that of zone A. A retention chamber 20 is defined between the inner lining 7 and portion 21 of outer casing 6. Retention chamber 20 serves to catch and retain large pieces of debris which have lost a significant portion of their energy through contact with the retention belt structure in zone B.

The thickness of the wall of the outer casing 6 in zones A and B must be resistent enough to withstand the vibrations and dynamic stresses encountered during the engine operation and are preferably twice the thickness of the wall in the zone C. The portions of the structure extending upstream and downstream from the aforementioned three zones may have a wall thickness substantially equal to that of the wall in zone C.

Radial flanges 22, 23 and 24 extend radially outward from the outer surface of outer casing 6 and serve to increase the rigidity and inertia of the outer casing.

Holes 25, 26 and 27 are provided through the outer casing 6 in zone B to facilitate the attachment of supports 17, and fittings 29 and 30 which may serve to attach accessories to the structure. A circumferential row of holes 31 is also provided adjacent the end of zone C to accommodate the fastening means for attaching the air-straightening vanes 5.

As can be seen in the FIGURE, the inner surface of outer casing 6 in zone A is provided with cylindrical bearing surfaces 32 and 33, the diameter of bearing surface 32 being greater than that of bearing surface 33. Inner lining 7 has correspondingly dimensioned bearing surfaces on its outer surface, which serve to contact the bearing surfaces 32 and 33 when the inner lining 7 is assembled into outer casing 6. The inner lining may be removably attached to the outer casing and may be assembled therewith by sliding it into the outer casing 6 from its upstream end in a downstream direction, after the retention belt structure 14 has been attached to the outer casing 6. As previously noted, the retention belt structure 14 comprises two toroid retention members 15 and 16 which are attached to the outer casing 6 by a plurality of supports 17. Supports 17 are approximately trapezoidal in cross-section and define two notches to accommodate the toroid retention members 15 and 16. Clamping members, such as bolts 25A, 26A and 27A are inserted through the outer casing 6 and engage correspondingly threaded holes formed in the supports 17. Bolts 25A and 26A may also serve to attach fittings 29 and 30 to the outer casing, which fittings may be utilized to attach accessories to the structure. The central portion of the supports 17 defines a threaded axial passage to accommodate bolt 27A passing through hole 27 in the outer casing 6. The end of the thread accommodates a supporting piece which spreads the nut clamping stresses over the central portion. Bolts 26A may also attach one end of a retaining fitting 34 to the outer casing 6. The opposite, downstream end of the retaining fitting 34 may be attached to inner lining 7 by a fastening means 38.

As is well known in the art, toroid retention members 15 and 16 may be fabricated from fiberglass, carbon or polyamide fibers wound into the toroid shape and encased in a polymerizing resin. The supports 17 may be made of a metal, such as titanium, but may also be fabricated from a composite material.

The structure according to the invention comprises: an upstream segment near the intake for the turbine which may include perforations through its wall thickness to act as an acoustic damper;

zone A wherein the inner lining is provided with a recess to receive an abradable sealing ring, which may be a honeycomb structure having a synthetic resin collar reinforced by glass fibers;

zone B having a retention belt structure; and, zone C having a retaining fitting, a retention chamber to retain the blade fragments of which the energy state was lowered in zone B, and which may have additional perforations to act as acoustic dampers.

The collar 35 formed on the upstream end of inner lining 7 has an outer periphery which forms a bearing surface which cooperates with bearing surface 36 formed on the inner portion of the upstream end of outer casing 6. Downstream of the aforementioned zones, a honeycomb structure 37 may be attached to the inner wall of outer casing 6 to act as an acoustic damper.

The lining 7 is a detachable assembly which can be installed or removed from the upstream end of the outer casing 6. The lining 7 is positioned within the outer casing 6 by the engagement of bearing surfaces 32, 33, 35 and 36, whose diameters decrease as they progress in the downstream direction. A downstream portion of the inner lining 7 is retained in place and attached to the retention fitting 34 by fastening means 38.

The lining 7 may be fabricated from a winding of organic or mineral fibers (such as fiberglass, carbon or KEVLAR) embedded in a synthetic resin. In other embodiments, the lining may include an inside skin and an outside skin made of metal ore fibers having a retaining structure therebetween made of honeycomb or a composite material. This type of lining may be utilized in those zones for both retention and/or acoustic dampening functions.

The foregoing is provided for illustrative purposes only and should not be construed as in any way limiting this invention, the scope of which is defined solely by the appended claims.

I claim:

1. A containment structure for a turbojet having at least one turbine rotor blade wheel within an engine housing comprising:

(a) a metallic outer casing attached to the engine housing, the outer casing having a generally annular shape and extending in an axial direction both upstream and downstream from a plane of rotation of the rotor blade wheel;

(b) an inner liner having a generally annular shape and extending in an axial direction both upstream and downstream from a plane of rotation of the rotor blade wheel;

(b) an inner liner having a generally annular shape and extending in an axial direction both upstream and downstream from the plane of rotation of the rotor blade wheel;

(c) a sealing ring disposed on the inner liner in a first zone located in the plane of rotation of the rotor blade wheel;

(d) a retention belt structure disposed between the outer casing and the inner liner and extending around the circumference of the inner liner in a second zone downstream of the first zone the retention belt structure comprising:

(i) a pair of toroid retention members; and, (ii) means to attach the toroid retention member to the outer casing;

(e) a retention chamber defined between the outer casing and the inner liner in a third zone downstream of the second zone;

(f) means to removably attach the inner liner to the outer casing;

(g) first, second and third annular bearing surfaces defined on an inner surface of the outer casing located upstream of the second zone, the diameters of the bearing surfaces decreasing in the downstream direction;

(h) fourth, fifth and sixth annular bearing surfaces defined on an outer surface of the inner lining located upstream of the second zone, the diameters of the bearing surfaces decreasing in the downstream direction, the fourth, fifth and sixth bearing surfaces located so as to contact the first, second and third bearing surfaces, respectively, when the inner liner is assembled with the outer casing;

(i) a retaining fitting disposed in the retention chamber;

(j) means to attach the retaining fitting to the outer casing and the inner liner, wherein the means to attach the retaining fitting to the inner liner is located in the third zone;

(k) a pair of flanges extending radially outwardly from the outer casing in the first zone; and, (l) a retention ring disposed about the outer casing between the radial flanges.

2. The containment structure according to claim 1 wherein the means to attach the toroid retention members to the outer casing comprises: a plurality of supports, each support having a generally trapezoidal cross-section defining a pair of notches to accommodate the toroidal retention members; and bolt means extending through the outer casing and threadingly engaging the supports to retain the toroidal retention members in position.

3. The containment structure according to claim 1 wherein the wall thickness of the outer casing in the first zone is greater than the wall thickness in the remainder of the outer casing.

4. The containment structure according to claim 3 wherein the wall of the outer casing in the first zone is approximately twice as thick as the wall of the remainder of the outer casing.

5. The containment structure according to claim 1 wherein the inner casing is formed from a winding of fibrous material embedded in a synthetic resin.

* * * * *